United States Patent [19]

Mihara et al.

[11] Patent Number: 4,961,300

[45] Date of Patent: Oct. 9, 1990

[54] CAN SEAMER

[75] Inventors: Hirokata Mihara, Tokyo; Koichi Takagi; Teruo Shimizu, both of Nagoya; Katsunori Tashiro; Hideo Takahashi, both of Sunto, all of Japan

[73] Assignee: Mitsubishi Jukogyo Kabushiki Kaisha, Tokyo, Japan

[21] Appl. No.: 291,789

[22] Filed: Dec. 29, 1988

[30] Foreign Application Priority Data

Dec. 29, 1987 [JP] Japan ..... 62-334109
May 19, 1988 [JP] Japan ..... 63-120756

[51] Int. Cl.[5] ..... B65B 7/28; B21D 51/26

[52] U.S. Cl. ..... 53/340; 413/27; 413/31

[58] Field of Search ..... 53/334, 336, 338, 340, 53/339; 413/27, 31, 38

[56] References Cited

U.S. PATENT DOCUMENTS

| | | | |
|---|---|---|---|
| 777,784 | 12/1904 | Gillette | 53/338 |
| 1,996,381 | 4/1935 | Lange . | |
| 2,152,571 | 3/1939 | Schmidt | 53/340 |
| 2,748,733 | 6/1956 | Pechy . | |
| 4,086,747 | 5/1978 | Gorton et al. | 53/340 |

*Primary Examiner*—Horace M. Culver
*Attorney, Agent, or Firm*—Wenderoth, Lind & Ponack

[57] ABSTRACT

A can seamer for seaming a lid to a can drum filled with liquid and having the lid placed on a top opening includes seaming rolls and a seaming chuck. The time necessary for replacement of the seaming rolls and the seaming chuck, when changing the diameter of the cans to be seamed, is greatly shortened. A seaming lever having the seaming rolls mounted thereon and the seaming chuck are respectively connected to the bottom end portions of a seaming roll shaft and a rotary cylinder via splines or serrations. The seaming lever and the seaming chuck are integrally connected by a connecting bracket.

5 Claims, 5 Drawing Sheets

CAN SEAMER

BACKGROUND OF THE INVENTION

1. Field of the Invention

The present invention relates to a can seamer in which a can filled with liquid and having a can lid placed on the opening at the top of the can is subjected to a seaming operation by means of seaming rolls and a seaming chuck.

2. Description of the Prior Art

One example the heretofore known can seamers as disclosed in Laid-Open Japanese Patent Specification No. 54-9137 (1979)- will be explained with reference to FIG. 7. In this figure, reference numeral 1 designates seaming rolls which are rotatably mounted on shafts 3 and 4, respectively, which are fixedly secured to a seaming lever 2. Reference numeral 5 designates a seaming chuck which is fixedly secured by a screw to the bottom of a rotary cylinder tube 6, and at the bottom of a knock-out rod 7, which extends through the rotary cylinder tube 6 is a vertically slidable manner, is fixedly secured by a screw 8 a knock-out pad 9. The knock-out pad 9 is projectable from a recessed portion 10 at the bottom of the above-mentioned seaming chuck 5.

In the above-mentioned known can seamer shown in FIG. 7, the shafts 3 and 4 having the seaming rolls 1 mounted thereon and the seaming chuck 5 are separately fixed by screws to the seaming lever 2 and the rotary cylinder tube 6, respectively. Accordingly, upon changing the can body or drum diameter and the can lid diameter, the mounting shafts 3 and 4 having the seaming rolls mounted thereon and the seaming chuck 5 fixed to the rotary cylinder tube 6, respectively, must be replaced separately. This presents various problems, such that since these members are fixed by screws and the seamer includes a large number of seaming rolls and seaming chucks, a long time is necessary for replacing such members, and moreover the relative adjustment of such members in the vertical direction as well as adjustment in the horizontal direction requires substantial time to achieve high precision.

SUMMARY OF THE INVENTION

It is therefore one object of the present invention to provide an improved can seamer which is free from the above-mentioned shortcomings of the can seamers of the prior art.

A more specific object of the present invention is to provide a can seamer which does not necessitate a long time for replacing seaming rolls and a seaming chuck when the drum diameter and the can lid diameter are changed.

According to one feature of the present invention, there is provided a can seamer, wherein a seaming lever having seaming rolls mounted thereon and a seaming chuck are respectively connected to the bottom end portions of a seaming roll shaft and a rotary cylinder via splines or serrations, and the seaming lever and the seaming chuck are integrally connected by means of a connecting bracket.

According to the present invention, in the case where it is necessary to replace the seaming rolls and the seaming chuck, if the seaming rolls as well as the same seaming chucks are grasped and pulled downwards, then the rolls and chuck can be removed integrally since they are connected by the connecting bracket. Subsequently, in order to mount other seaming rolls and another seaming chuck having changed sizes, by merely pushing up the seaming rolls and the seaming chuck with their respective splines (or serrations) aligned with the splines (or serrations) of the seaming roll shaft and rotary cylinder, mounting of the seaming rolls and the seaming chuck can be achieved easily. Thereby, replacement by the new members having the changed sized can be performed quickly.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
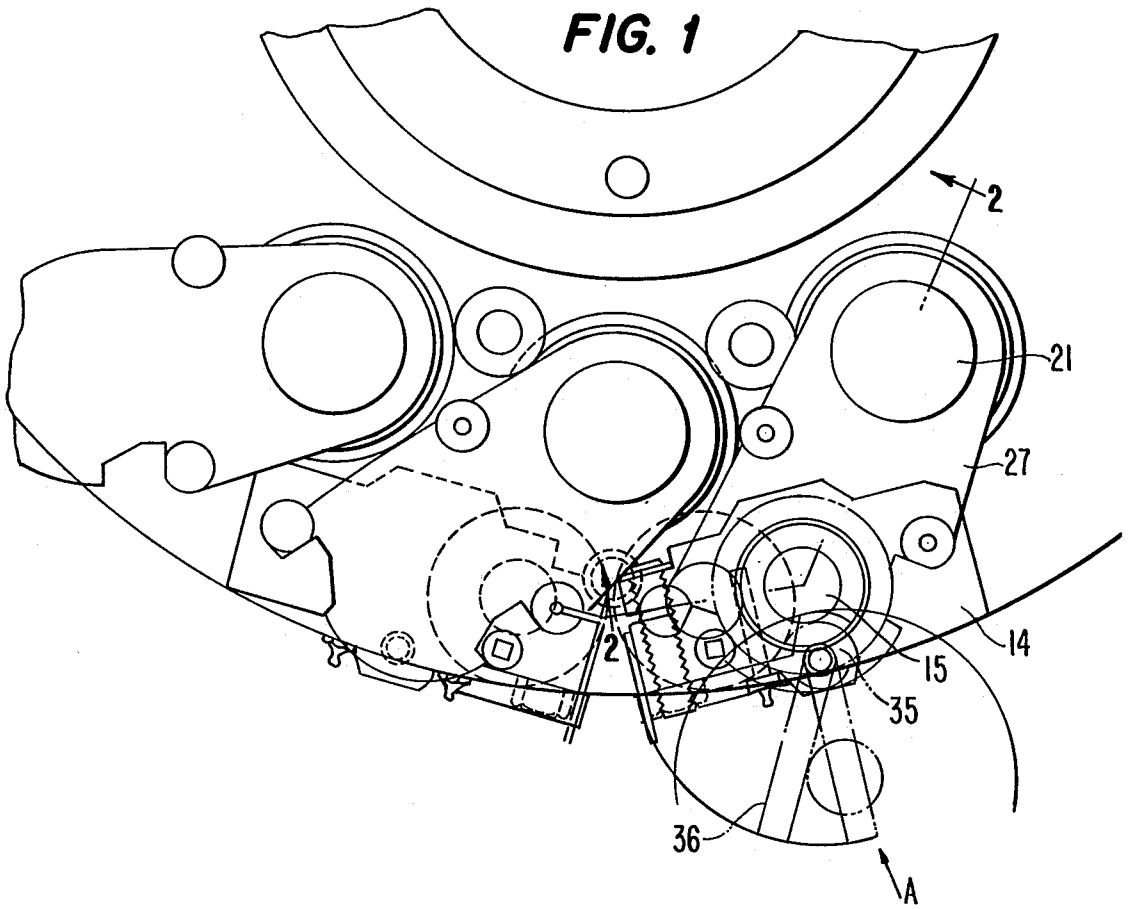
FIG. 1 is a plan view showing a part of a can seamer according to one preferred embodiment of the present invention.
Figure 2:
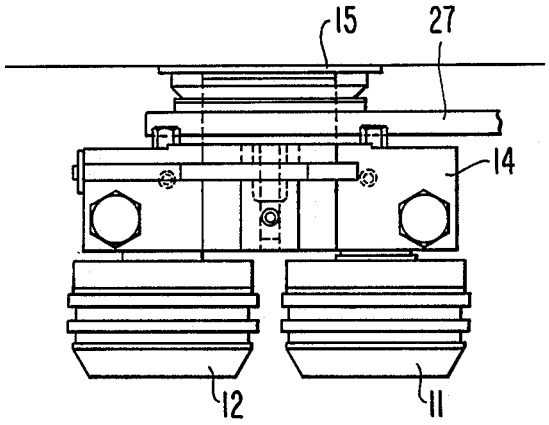
FIG. 2 is a schematic partial side view as viewed in the direction of arrow A in FIG. 1.
Figure 3:
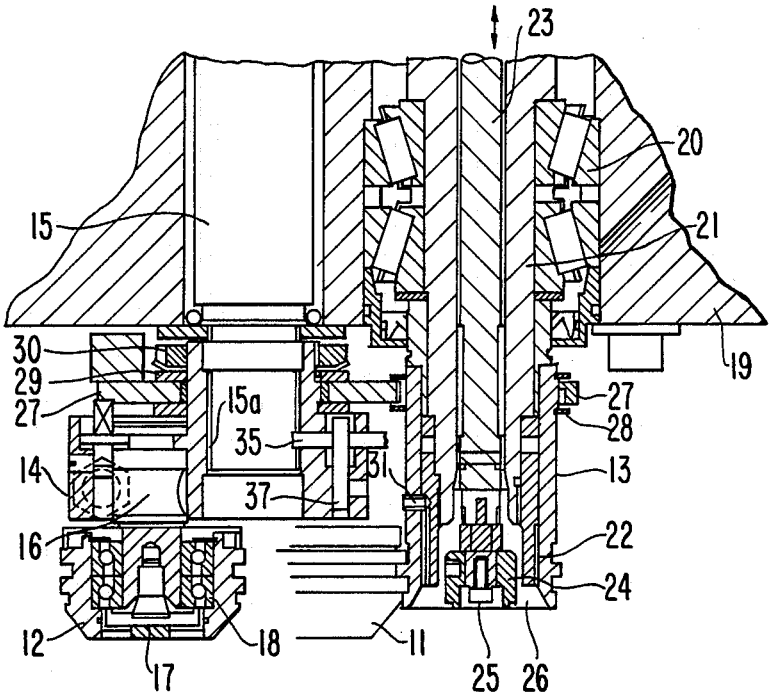
FIG. 3 is a cross-sectional view taken along line II—II in FIG. 1 as viewed in the direction of the arrows.

The present invention now will be described in greater detail in connection with preferred embodiments of the invention illustrated in the accompanying drawings. In a first preferred embodiment of the present invention shown in FIGS. 1 to 3, reference numeral 11 designates a first seaming roll, numeral 12 designates a second seaming roll, and numeral 13 designates a seaming chuck. Reference numeral 14 designates a seaming lever which is inserted onto a seaming roll shaft 15 via splines (or serrations) **15*a* so that it can be drawn out downwards. However, lever 14 is fixed to the shaft 15 so as to be able to rotate integrally therewith, and in addition, shafts 16 are fixed to the seaming lever 14. The seaming rolls 11 and 12 are rotatably suspended at the centers of the bottoms of the respective shafts 16 via bearings 18 fixed to the bottom portions of the shafts 16 by means of screws 17. On the other hand, the seaming chuck 13 is mounted via splines (or serrations) 22 to the bottom of a rotary cylinder 21 that is rotatably supported via a bearing 20 from a can seamer main body 19 so that the seaming chuck 13 can rotate integrally with the rotary cylinder 21. In addition, a knock-out rod 23 extends through the rotary cylinder 21 in a vertically slidable manner and at the bottom of this rod 23 is fixed by a screw 25 a knock-out pad 24. The knock-out pad operates to be projected from a recess 26 at the bottom of the seaming chuck 13 to cause a packaging can subjected to a seaming operation to be disengaged from the seaming chuck 13**.

Reference numeral 27 designates a connecting bracket which integrally connects the seaming lever 14 with the seaming chuck 13. More particularly, this connecting bracket 27 is connected with the seaming chuck 13 via flanges 28 provided on the outer circumference of chuck 13. Bracket 27 also is connected with the seaming lever 14 via rings 29, and rings 29 are rotatably fixed by means of a lock nut 30 engaged with the lever 14. In addition, reference numeral 31 designates bolts for positioning the seaming chuck 13 in the vertical direction with respect to the rotary cylinder 21. Upon seaming a can, normally the can exerts a push-up force upon the seaming chuck 13, and thus an upward force is also exerted upon the seaming rolls which are connected with the seaming chuck 13 by means of the connecting bracket 27. However, in order to prevent the seaming rolls, the connecting bracket and the seaming chuck from dropping at those times when a can seaming operation is not effected, a cam 35 is rotated about the center axis of a shaft 37 by means of a lever 36 and is pressed against the seaming roll shaft 15. Thereby, dropping of such members can be prevented.

Description now will be made of the operations of the above-described can seamer. When it is necessary to replace the seaming rolls 11 and 12 and the seaming chuck 13 in according with a change of the can lid diameter, after the lever 36 has been turned about the shaft 37 to separate the cam 35 from the seaming roll 15, the seaming rolls 11 and 12 and the seaming chuck 13 are grasped and pulled down. Since the seaming lever 14 and the seaming chuck 13 are integrally connected by the connecting bracket 27, the seaming lever 14 is disengaged from the seaming roll shaft 15 via the splines **15*a*. Also, the seaming chuck 13 is disengaged from the rotary cylinder 21 via the splines 22. Thus, all such members are pulled down integrally due to the intermediary of the connecting bracket 27**.

Subsequently, in order to mount a new seaming lever 14 having seaming rolls 11 and 12 of the changed size mounted thereon and a new seaming chuck 13 of the changed size, such mounting can be achieved within a short period of time by merely aligning the splines of the new seaming lever 14 with the splines **15*a* of the seaming roll shaft 15 and the spline of the new seaming chuck 13 with the spline 22** and pushing them up, since the spline diameters of the new members are identical to those of the old or removed members.

Figure 4:
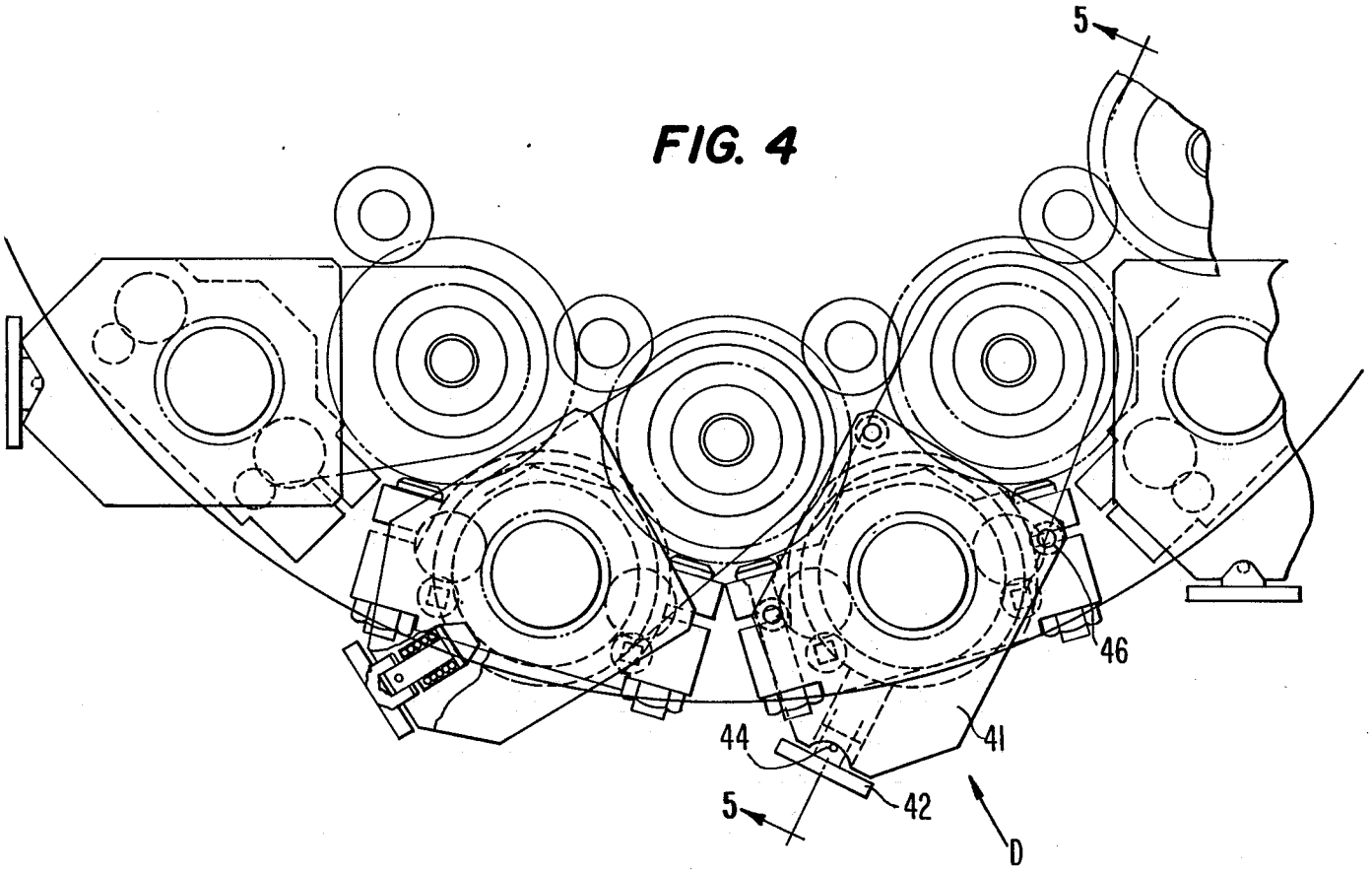
FIG. 4 is a plan view showing a part of a can seamer according to another preferred embodiment of the present invention.
Figure 5:
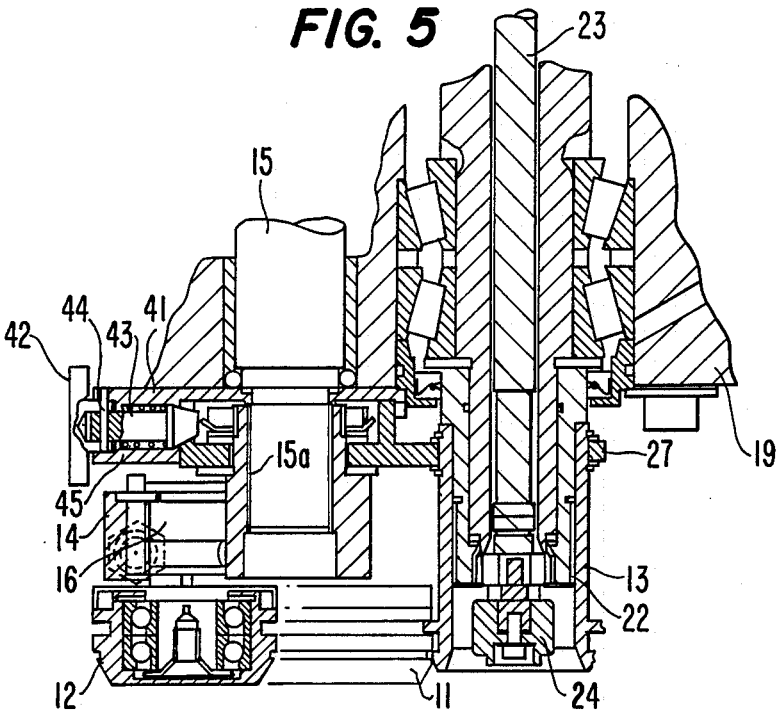
FIG. 5 is a cross-sectional view taken along line V—V in FIG. 4 as viewed in the direction of the arrows.
Figure 6:
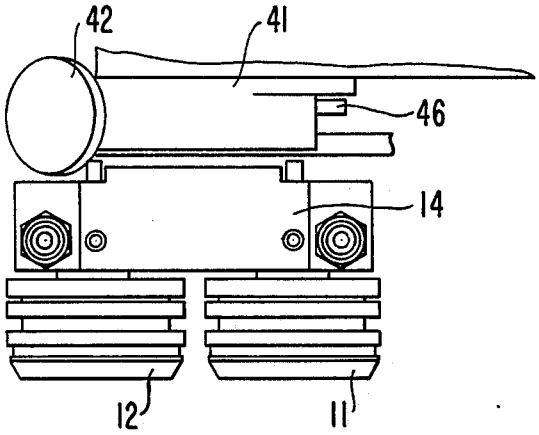
FIG. 6 is a schematic partial side view as viewed in the direction of arrow D in FIG. 4.
Figure 7:
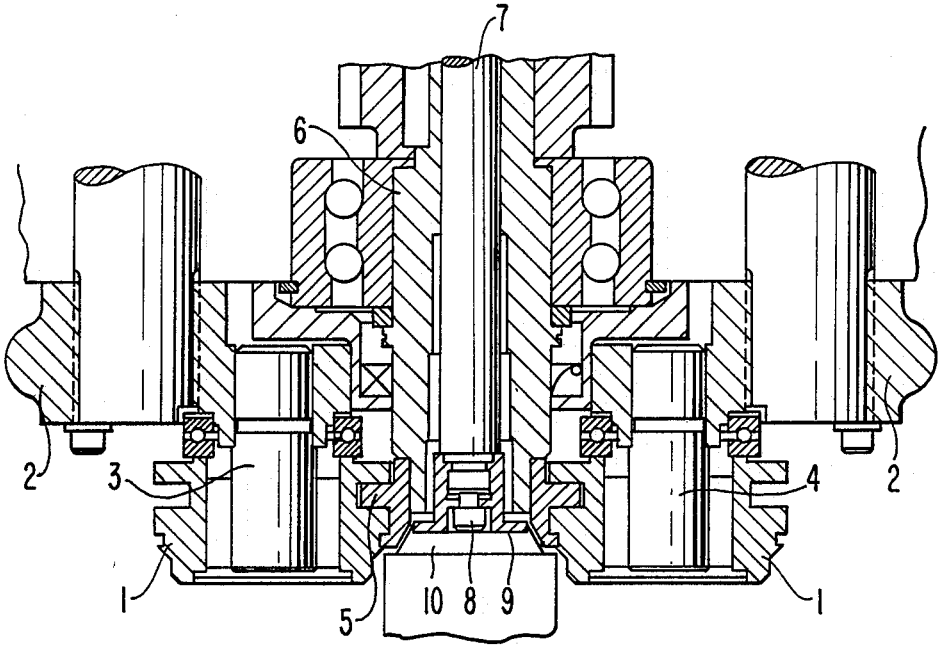
FIG. 7 (PRIOR ART)
FIG. 7 is a longitudinal cross-sectional view showing seaming rolls and a seaming chuck in a heretofore known can seamer.

FIGS. 4 to 6 illustrate a second preferred embodiment of the present invention, in which a connecting bracket 27 is directly mounted to a can seamer main body 19 via a mounting bracket 41. More particularly, as shown in FIG. 5 which is a cross-sectional view taken along line V—V in FIG. 4, a seaming lever 14 and a seaming chuck 13 are rotatably mounted to the connecting bracket 27. In addition, a mounting bracket 41 is fixedly secured to the can seamer main body 19 by means of bolts 46, and at an outer circumferential portion of the bracket 41 is mounted a pin 43 so as to be movable in its axial direction under the bias of a spring 45 towards an innermost position.

In the case where the bracket 27 and component parts integrally connected therewith are to be dismounted, a knob 42 at the outer end of the pin 43 is pulled and rotated to cause a transverse pin 44 projecting from the pin 43 to engage with a projected portion of the mounting bracket 41. Thereby, the tip end of the pin 43 is held in a retreated or withdrawn position, and then the bracket 27 is movable downwards. On the contrary, upon mounting these members, the bracket 27 is inserted upwardly under the above-mentioned condition, and then pin 43 is released from its withdrawn position and the tip end of the pin 43 is inserted into a tapered hole formed in one part of the bracket 41 to fix the bracket 27 against vertical movement and rotation. The modified embodiment shown in FIGS. 4 to 6 is not different in effects and advantages from the first embodiment shown in FIGS. 1 to 3.

Since the can seamer according to the present invention is constructed as described in detail above, i.e. such that the seaming rolls and the seaming chuck can be replaced simultaneously since they are connected by the connecting bracket, various advantages can be realized. Thus, replacement time can be shortened greatly compared to the case where the seaming rolls and the seaming chuck are respectively separately replaced as is the case with the prior art. Also, time for mutual fine adjustment of these members is quite unnecessary compared to the case where such members were separately mounted and individually adjusted as is the case with the prior art.

While a principle of the present invention has been described above in connection to preferred embodiments of the invention, it is a matter of course that many apparently widely different embodiments of the present invention could be made without departing from the spirit of the present invention.

What is claimed is:

1. A can seamer apparatus for seaming a can lid to a can body, said apparatus comprising:

a rotary cylinder having a lower end portion;

a seaming chuck mountable axially on said lower end portion of said rotary cylinder by means of a spline or serration connection therebetween, such that said seaming chuck is rotatable with said rotary cylinder;

a seaming roll shart having a lower end portion;

a seaming lever mountable axially on said lower end portion of said seaming roll shaft by means of a spline or serration connection therebetween, such that said seaming lever is rotatable with said seaming roll shaft;

seaming rolls mounted on said seaming roll shaft; and a connecting bracket connecting said seaming lever to said seaming chuck, such that said seaming lever and said seaming chuck are removable from and mountable on said seaming roll shaft and said rotary cylinder, respectively, as a unit with said connecting bracket.

2. An apparatus as claimed in claim 1, further comprising means for maintaining said seaming lever and said seaming chuck in operable mounted positions on said seaming roll shaft and said rotary cylinder, respectively.

3. An apparatus as claimed in claim 2, wherein said means comprises a lever having thereon a cam and mounted for pivotal movement between a locked position whereat said cam bears against said seaming roll shaft, thereby preventing axial movement of said unit, and an unlocked position whereat said cam is spaced from said seaming roll shaft, thereby allowing axial movement of said unit.

4. An apparatus as claimed in claim 2, wherein said means comprises a fixedly positioned mounting bracket, and a pin movable relative to said mounting bracket between a locked position whereat said pin engages said connecting bracket, thereby preventing axial movement of said unit, and an unlocked position whereat said pin is spaced from said connecting bracket, thereby allowing axial movement of said unit.

5. An assembly for use in a can seamer apparatus of the type including a rotary cylinder having a lower end portion and a seaming roll shaft having a lower end portion, for seaming a can lid to a can body, said assembly comprising:

a seaming chuck adapted to be mountable axially on the lower end portion of the rotary cylinder by means of a spline or serration connection therebetween to enable said seaming chuck to be rotatable with the rotary chuck;

a seaming lever adapted to be mounted axially on the lower end portion of the seaming roll shaft by means of a spline or serration connection therebetween to enable said seaming lever to be rotatable with the seaming roll shaft;

seaming rolls mounted on said seaming lever; and a connecting bracket connecting said seaming lever to said seaming chuck, such that said seaming lever and said seaming chuck may be removed from and mounted on the seaming roll shaft and the rotary cylinder, respectively, as a unit with said connecting bracket.

* * * * *